US009592426B1

(12) United States Patent
DiPietro

(10) Patent No.: US 9,592,426 B1
(45) Date of Patent: Mar. 14, 2017

(54) GAME BALL FOR CONFINED FIELD OF USE/PLAY

(71) Applicant: Stephen DiPietro, Miami, FL (US)

(72) Inventor: Stephen DiPietro, Miami, FL (US)

( * ) Notice: Subject to any disclaimer, the term of this patent is extended or adjusted under 35 U.S.C. 154(b) by 0 days.

(21) Appl. No.: 14/724,662

(22) Filed: May 28, 2015

Related U.S. Application Data

(60) Provisional application No. 62/004,582, filed on May 29, 2014.

(51) Int. Cl.
*A63B 39/00* (2006.01)
*A63B 43/00* (2006.01)

(52) U.S. Cl.
CPC ..... *A63B 39/00* (2013.01); *A63B 2039/003* (2013.01)

(58) Field of Classification Search
CPC ..... A63B 2041/005; A63B 2043/001; A63B 43/002; A63B 43/04; A63B 43/00; A63B 39/00; A63B 2039/003; A63B 69/3655; A01K 15/025
USPC ..... 473/594, 595, 280, 281, 612, 613; 446/419; 119/707–711
See application file for complete search history.

(56) References Cited

U.S. PATENT DOCUMENTS 693,821 A * 2/1902 De Ford ..... A63F 7/048 273/144 B
996,458 A * 6/1911 Coleman ..... A63F 7/044 273/115
1,483,165 A * 2/1924 Eaton ..... A63B 69/3655 473/281
2,211,330 A * 8/1940 Hochberg ..... A63F 7/0005 273/118 D
2,776,139 A * 1/1957 Blamey, Jr. ..... A63B 43/00 473/613
3,633,587 A * 1/1972 Hunt ..... A63H 5/00 446/409
3,908,994 A * 9/1975 Astrom ..... A63B 43/00 473/281
3,995,855 A * 12/1976 Schultz ..... A63B 43/04 446/437
4,088,319 A * 5/1978 Clarke ..... A63B 43/02 273/317
4,756,530 A * 7/1988 Karman ..... A63F 7/042 273/110
5,351,650 A * 10/1994 Graves ..... A01K 15/025 119/707
D352,753 S * 11/1994 Giannini ..... D21/678
(Continued)

*Primary Examiner* — Steven Wong
(74) *Attorney, Agent, or Firm* — John H. Faro, Esq.

(57) ABSTRACT

A game ball of composite construction, having a spherical hollow shell, with a pattern of perforation or holes arranged on and through the surface thereof, to substantially increase the aerodynamic drag upon the composite, and thereby effective reduce the distance the composite can travel upon being struck by a bat or club. In order to modulate and better emulate or mimic the feel and track of the composite in play, the composite is further modified by the inclusion of a plurality of randomly ordered discrete spherical elements, within said hollow shell, to effectively displacing about 50% of the interior volume of the hollow shell, and thereby contributing from about 20% up to about 75% to the mass of said composite In the composite embodiment of this invention game ball is a golf ball.

3 Claims, 2 Drawing Sheets

(56) References Cited

U.S. PATENT DOCUMENTS

| | | | | |
|---|---|---|---|---|
| 6,012,997 | A * | 1/2000 | Mason | A63B 43/00 273/DIG. 20 |
| 6,056,622 | A * | 5/2000 | Chung | A63B 43/04 446/435 |
| 6,186,095 | B1 * | 2/2001 | Simon | A01K 15/025 119/707 |
| 7,780,555 | B2 * | 8/2010 | Wong | A63B 41/00 473/594 |
| D711,988 | S * | 8/2014 | Gubany | D21/709 |
| 2011/0275463 | A1 * | 11/2011 | Lim | A63B 43/00 473/613 |
| 2014/0274465 | A1 * | 9/2014 | Francis | A63B 43/00 473/351 |

* cited by examiner

GAME BALL FOR CONFINED FIELD OF USE/PLAY

CROSS-REFERENCE TO RELATED PATENT APPLICATION

This application claims priority to the commonly owned Provisional Patent Application, entitled "Plastic Golf Ball With Holes, Filled With Spheres for Practice", Ser. No. 62/004,582, filed May 9, 2014.

BACKGROUND OF THE INVENTION

1. Field of the Invention

This invention relates to an article of manufacture. More specifically, this invention relates to an improved game ball for use in a confined field of use/play, wherein the game ball is of a composite construction having an essentially a hollow sphere having (a) multiple perforation in the side wall thereof to increase the resistance to flight, and thus reduce the distance of travel when thrown or struck with a bat or golf club, and (b) a plurality of discrete inclusions (e.g. solid spherical particles) relatively unconstrained therein, to increase the total mass of the game ball, and yet preserving substantially preserving the aerodynamic resistance of the game ball to flight.

This increase in mass surprising enhances both the player experience and yet preserves the use of the game ball (10) in a confined field of play.

2. Description of the Prior Art

The configuration of a game ball with increased resistance to flight in well-known, the so-called Whiffle™ ball. This type of game ball has been described in the patent literature and in commerce over the year as comprising a hollow plastic sphere having numerous perforations in the side wall thereof, (typically in a some symmetrical or ordered pattern). The ostensible purpose of the design of the Whiffle™ style ball is to increase the aerodynamic resistance (drag) of the ball as it travels through the air, and thereby reduce the distance the ball travels, The hollowed out construction of the Whiffle™ style of game ball also reduces the mass (weight) of the ball and, thus, the absorption of energy imparted to the ball by throwing or striking the ball. While such construction has provided substantial control over the distance this Whiffle™ ball can travel, it does not, however, provide a comparable user experience, in that the sound or feel of the bat/club striking the ball is not the same and the flight path is not true.

Accordingly, there continues to exist a need to provide an improved game ball suitable for use in a confined field of use/play, and yet has a user experience, to a comparable unmodified game ball (10) which is used in an unrestricted field of play.

OBJECTS OF THE INVENTION

It is the object of this invention to remedy the above as well as the related deficiencies in the prior art.

More specifically, it is the principle object of this invention to an improved game ball suitable for use in a confined or restricted field of play which has both a reduced aerodynamic profile and comparable user experience.

It is another object of this invention to provide to an improved game ball suitable for use in confined or restricted field of play which is comparable to an unmodified with respect to the feel (feedback) on the bat or club striking the ball.

It is yet another object of this invention to provide to an improved game ball suitable for use in a confined or restricted field of play which is comparable to an unmodified with respect to the sound of bat or club striking the ball.

It is still yet another object of this invention to provide to an improved game ball suitable for use in a confined or restricted field of play which is comparable to an unmodified with respect to the flight path ball (10) as it leaves the bat or club upon the striking the ball.

Additional objects of invention include the use of this improved game ball in a game having a confined field of play.

SUMMARY THE INVENTION

The above and related objects of this invention are achieved by providing a game ball (10) of composite construction, having a spherical hollow shell (14), with a pattern of perforation or holes arranged on and through the surface thereof, to substantially increase the aerodynamic drag upon the composite, and thereby effective reduce the distance the composite can travel upon being struck by a bat or club. In order to modulate and better emulate or mimic the feel and track of the composite in play, the composite is further modified by the inclusion of a plurality of randomly ordered discrete spherical elements, within said hollow shell (14), to effectively displacing about 50% of the interior volume of the hollow shell (14), and thereby contributing from about 20% up to about 75% to the mass of said composite. The balancing or modulation of the aerodynamic drag upon the composite, by the inclusion of discrete, within said hollow shell (14), surprisingly improves both player experience by more closely mimicking the performance of a game ball, and yet retains the obvious advantage of limiting the range or distance of travel of the composite.

In the preferred embodiments of this invention, the composite performance (distance of travel) when struck by a bat or club, typically ranges from about 10% to about 30% of the game ball (10) which it is intended to mimic.

DETAILED DESCRIPTION OF THE INVENTION INCLUDING PREFERRED EMBODIMENTS

Figure 1A:
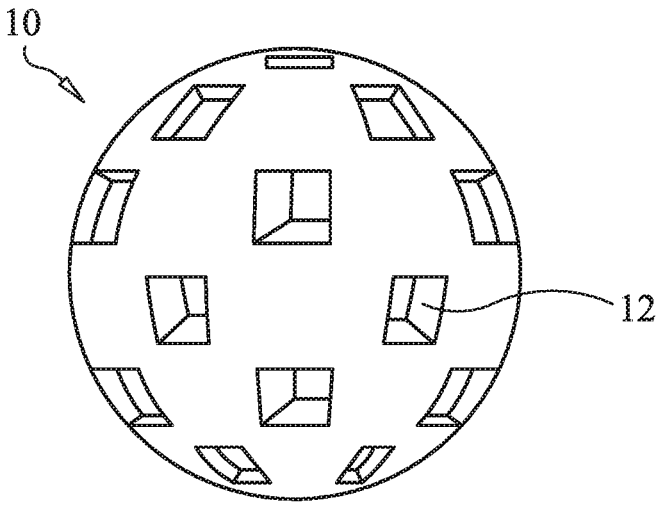
FIG. 1A PRIOR ART
FIG. 1A is a perspective view of classic Whiffle™ ball (10) configuration, of the type disclosed in the Prior Art.
Figure 1B:
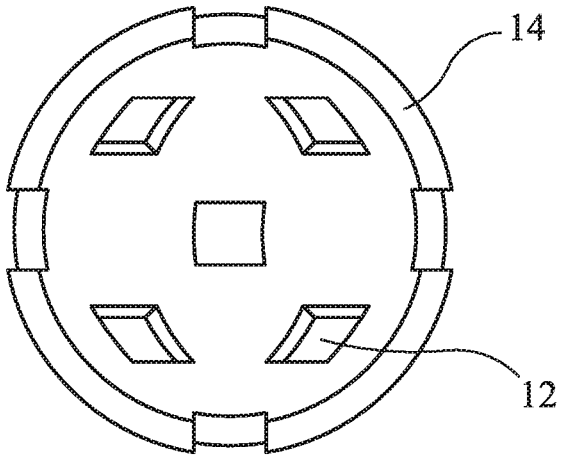
FIG. 1B PRIOR ART
FIG. 1B is a cross-sectional view of the classic Whiffle™ ball (10) configuration of FIG. 1A.

FIG. 1 depicts a classic example of a Whiffle™ had (10) construct. The classic Whiffle ball (10) is hollow and comprises a spherical shell having multiple holes (24, 26) in the shell. In practice the typical Whiffle ball (10) is formed by initially molding two separate symmetrical component half-shells, which are then joined together by applying an adhesive (or solvent) to the interface of each component half-shell (14), or by sonic welding of the two halves together. The number of holes in each half-shell of this construct is determine empirically, depending upon the aerodynamic resistance (drag) which is desired, and limited or confined area of intended use. Moreover, because the Whiffle™ ball (10) is hollow (minimal mass), the amount of energy which can be absorbed/transferred by throwing or impact is very limited.

Figure 2:
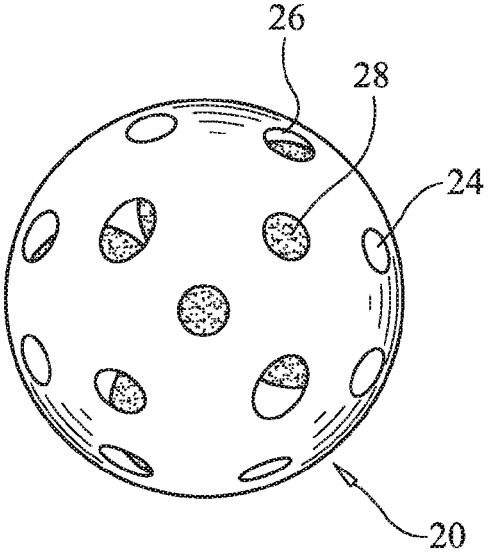
FIG. 2 depicts an improved game gall of this invention in the form of a golf ball.
Figure 3:
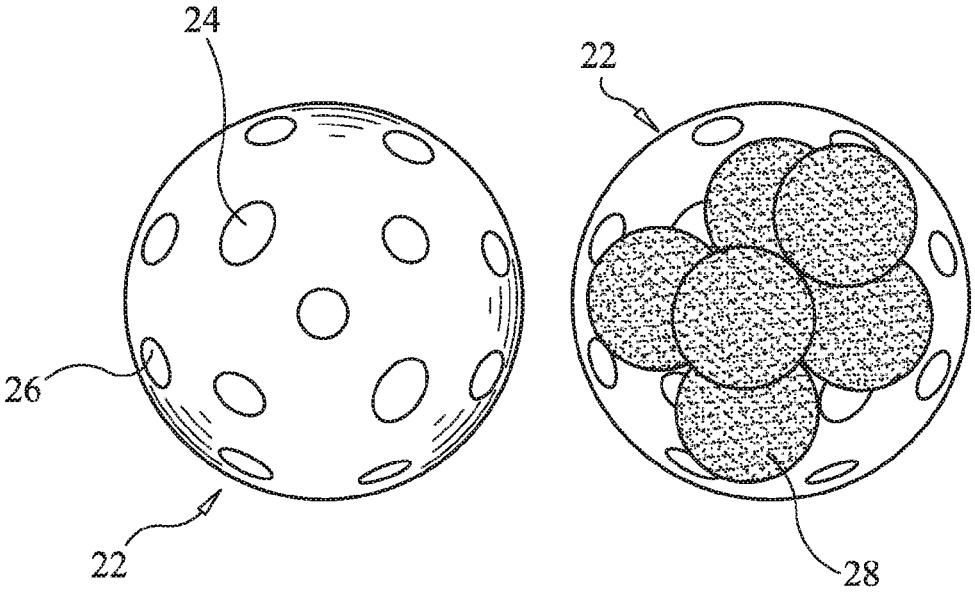
FIG. 3 depicts an exploded view of the improved game ball (10) of FIG. 2

The illustration of the preferred embodiment of this depicted in FIG. 2 is a golf ball (20). In this embodiment of the invention, the basic construct is the same as the traditional Whiffle™ ball, specifically, it also comprise a spherical half-shells (22) having multiple holes (24, 26) in each of the half-shells (22). Moreover, the basic process of the construct of the finished assembly is also similar, with very notable difference—the inclusion of a plurality of loosely constrained inclusions (28), (preferably mini-sphere), within the resulting sphere.

In the preferred embodiments of this invention, the number and weight of such inclusions (28) increases the mass of a typical Whiffle™ golf ball (10) construct from about 3-4 grams to about 19-20 grams, or by about 5 times its unmodified mass. This increase in mass of this golf ball (10) construct results in (a) improved user sensation (feel and sound) when striking the ball, (b) a more true flight path off the club head (c) an increase in the distance from approximately 50 feet to approximately 150 feet, and, (d) a reduction in the distance of travel, in comparison to a golf ball, from about 25 to about 75%. Thus, a five-fold increase in mass (from 4 grams to 20 grams), still provides a game ball (10) with a confined field of use.

The variation in the amount of the loosely constrained inclusions (28) within this golf ball (10) construct is scalable, and, thus, increasing or decreasing the mass of the construct is readily accomplished by varying the density of the inclusions (28) contained therein. In the preferred embodiments of this invention, the inclusions (28) which are confined within the shell of the golf ball (10) comprise neoprene rubber spheres, approximately 15.87 mm (⅝") in diameter, having a density of 1.4 grams/cc. These neoprene rubber spheres are commercially avail from a number of sources, including CIC Ball (10) Company, 2280 Amber Drive, Hatfield, Pa. 19440 (Item No. EPDM 70D06250 BG). In this preferred embodiment of the invention, six (6) of these neoprene rubber spheres are placed with the game ball (10) shell at the time of assembly. In this embodiment of the invention, these neoprene rubber spheres displace approximately 40% of the interior volume of the golf ball, and thereby reduces the air flow through the ball (10) and, thus, the aerodynamic resistance (drag) on the ball. Such reduction in the aerodynamic resistance (drag) substantially modifies the night path (distance) of the ball (10) off the club. In one of the preferred golf ball (10) embodiments of this invention, the surface of the game ball (10) is dimpled in a manner comparable to a traditional golf ball. It is believed that such dimpling permits greater control of the golf game ball, by increasing the interaction of the surface of club head with surface of the ball, specifically, the ability to control the direction of the ball (10) (draw or slice), as appropriate by deliberate stroke play.

As above noted, the inclusion of these neoprene rubber spheres within the interior, hollow space within the ball, increases the mass of the ball (10) by a factor of 4-5 times; and, thus, the ability of the ball (10) to absorb more energy in use. These six (6) neoprene rubber spheres are loosely constrained within the ball (10) shell (14), and undergo limited movement when energy is imparted to ball.

Additional notable differences in this embodiment of the invention included the variation in the size off holes in the shell of the construct, specifically, have at least two different size of holes in the shell wall, to further modulate the aerodynamic resistance (drag) of the game ball. A typical Whiffle™ ball (10) construct has a symmetrical array of holes in its shell wall on the order of approximately 7/32". In the preferred embodiments of this invention, each size of hole in the shell is in the form of a pattern, or ordered array relative to one another. In the embodiments of this invention, the holes in the shell wall are preferably 7/32" and 9/32", and are of equal number (13 each) in a deliberate pattern in the shell wall.

This invention is not limited in its intended scope to golf ball (10) constructs, and is applicable to other practice ball (10) systems, (e.g. baseball, softball). In each case, the mass of the practice ball (10) construct will comprise a hollow shell and have a reduced mass (in comparison to an unmodified ball (10) construct), perforations in the shell wall and a plurality inclusions (28) confined within the shell. The aerodynamic resistance (drag) on the ball (10) will be (a) tailored to the ambient environment of use, (batting cage, Pee Wee baseball (10) or softball, etc.); (b) modulated to emulate the user experience with a comparable unmodified ball (10) construct; and, (c) have reduced the distance of travel of the modified ball (10) to permit its use in a confined game environment, or, alternatively, to playing field for younger children.

What is claimed is:

1. In a practice golf ball having a hollow core and a shell wall with multiple perforations therein to modulate aerodynamic resistance (drag) of said practice golf ball, and thereby reduce the distance of travel when struck by a golf club, wherein the improvement comprising A. Composite structure having a shape conforming in overall dimensions to a golf ball, and mass defined by a a. hollow spherical shell with (i) a defined interior volume and mass, having at least 50% of said interior volume of said shell being displaced with randomly arranged discrete spherical elements, and (ii) a pattern of holes in said shell, ranging from about 7/32" to about 9/32', in diameter, for effectively increasing aerodynamic drag of said practice golf ball in flight, and thereby reducing said distance of travel of said practice golf ball, when struck by a golf club, from about 25 to about 75% and, b. a plurality of discrete spherical elements within said hollow spherical shell, arranged in random order, so as to displace at least 50% of said interior volume within said hollow spherical shell, and increase said mass of said composite, thereby contributing from about 20% up to about 75% to the mass of said composite, B. An abrasion resistance coating on said hollow spherical shell of said composite.

2. In a practice soft ball having a hollow core, and a shell wall with multiple perforations therein to modulate aerodynamic resistance (drag) of said practice soft ball and thereby reduce the distance of travel when struck by a bat, wherein the improvement comprising:

A. A composite structure having a shape conforming in overall dimensions to a soft ball, and mass defined by a a. hollow spherical shell with (a) a defined interior volume and mass, having at least 50% of said interior volume of said shell being displaced with randomly arranged discrete spherical elements, and (b) a pattern of holes in said shell, ranging from about 7/32" to about 9/32', in diameter, for effectively increasing aerodynamic drag of said practice soft ball in flight, and thereby reducing said distance of travel of said practice soft ball, when struck by a bat, from about 25 to about 75% and, b. a plurality of discrete spherical elements within said hollow spherical shell, arranged in random order, so as to displace at least 50% of said interior volume within said hollow spherical shell, and increase said mass of said composite, thereby contributing from about 20% up to about 75% to the mass of said composite, and B. An abrasion resistance coating on said hollow spherical shell of said composite.

3. In a practice baseball having a hollow core and a shell wall with multiple perforations therein to modulate aerodynamic resistance (drag) of said practice baseball, and thereby reduce the distance of travel when struck by a bat, wherein the improvement comprising A. Composite structure having a shape conforming in overall dimensions to a baseball and mass defined by a a. hollow spherical shell with (a) a defined interior volume and mass, having at least 50% of said interior volume of said shell being displaced with randomly arranged discrete spherical elements, and (b) a pattern of holes in said shell, ranging from about 7/32" to about 9/32', in diameter, for effectively increasing aerodynamic drag of said practice baseball in flight, and thereby reducing said distance of travel of said practice baseball, when struck by a baseball bat, from about 25 to about 75% and, b. a plurality of discrete spherical elements within said hollow spherical shell, arranged in random order, so as to displace at least 50% of said interior volume within said hollow spherical shell, and so as to increase said mass of said composite, thereby contributing from about 20% up to about 75% to the mass of said composite, and B. An abrasion resistance coating on said hollow spherical shell of said composite.

* * * * *